US011723404B2

(12) United States Patent
Lin et al.

(10) Patent No.: US 11,723,404 B2
(45) Date of Patent: Aug. 15, 2023

(54) ELECTRONIC CIGARETTE VAPORIZER AVOIDING LIQUID LEAKAGE DURING USING

(71) Applicant: HUIZHOU HAPPY VAPING TECHNOLOGY LIMITED, Guangdong (CN)

(72) Inventors: Guangrong Lin, Guangdong (CN); Xianbin Zheng, Guangdong (CN)

(73) Assignee: HUIZHOU HAPPY VAPING TECHNOLOGY LIMITED, Huizhou (CN)

( * ) Notice: Subject to any disclaimer, the term of this patent is extended or adjusted under 35 U.S.C. 154(b) by 647 days.

(21) Appl. No.: 16/960,542

(22) PCT Filed: Jan. 18, 2019

(86) PCT No.: PCT/CN2019/072336

§ 371 (c)(1),
(2) Date: Jul. 7, 2020

(87) PCT Pub. No.: WO2019/137561

PCT Pub. Date: Jul. 18, 2019

(65) Prior Publication Data

US 2021/0059308 A1 Mar. 4, 2021

(30) Foreign Application Priority Data

Jan. 15, 2018 (CN) ..... 201810035931.3
Jan. 29, 2018 (CN) ..... 201810083045.8

(51) Int. Cl.
*A24F 40/40* (2020.01)
*A24F 40/46* (2020.01)
(Continued)

(52) U.S. Cl.
CPC ..... *A24F 40/40* (2020.01); *A24F 40/42* (2020.01); *A24F 40/46* (2020.01); *A24F 40/10* (2020.01); *A24F 40/485* (2020.01)

(58) Field of Classification Search
CPC ..... A24F 40/40; A24F 40/10; A24F 40/42; A24F 40/46
See application file for complete search history.

(56) References Cited

U.S. PATENT DOCUMENTS

2019/0364972 A1* 12/2019 Lin ..... A24F 40/485
2019/0387800 A1* 12/2019 Lin ..... A24F 40/485
(Continued)

FOREIGN PATENT DOCUMENTS

CN 206547882 U 10/2017

OTHER PUBLICATIONS

International Search Report of PCT Patent Application No. PCT/CN2019/072336 dated Mar. 20, 2019.

*Primary Examiner* — Hae Moon Hyeon

(57) ABSTRACT

An electronic cigarette vaporizer comprises a housing and a bottom cap, and a vaporizing base, a vaporizing unit and a vaporizing cover part arranged within the housing. The vaporizing base is provided in a center with a rectangular groove. The vaporizing unit comprises a liquid guiding strip and a heating coil wound around a middle portion of the liquid guiding strip. The liquid guiding strip is transversely arranged above the rectangular groove. The vaporizing cover part is arranged on the vaporizing base. A vaporizing chamber is defined between the lower portion of the vaporizing cover part and the vaporizing base. The upper portion of the vaporizing cover part is provided with a conical tube with an inner diameter increasing downwardly. The upper end of the conical tube is sleeved within the inner conical
(Continued)

tube. The mouthpiece hole is in communication with the vaporizing chamber by the conical tube.

10 Claims, 6 Drawing Sheets

(51) Int. Cl.

| | |
|---|---|
| ***A24F 40/42*** | (2020.01) |
| *A24F 40/10* | (2020.01) |
| *A24F 40/485* | (2020.01) |

(56) References Cited

U.S. PATENT DOCUMENTS

| | | | | |
|---|---|---|---|---|
| 2022/0248751 | A1* | 8/2022 | Hu | A24F 40/10 |
| 2022/0369708 | A1* | 11/2022 | Liu | A24F 40/42 |
| 2023/0035530 | A1* | 2/2023 | Wu | A24F 40/485 |

* cited by examiner

B-B

ELECTRONIC CIGARETTE VAPORIZER AVOIDING LIQUID LEAKAGE DURING USING

TECHNICAL FIELD

The disclosure relates to the field of electronic cigarettes, more particularly to an electronic cigarette vaporizer.

BACKGROUND

The electronic cigarettes usually heat the e-cigarette liquid by means of a vaporizer, to produce vapor for the user. Since the e-cigarette liquid does not contain tobacco tars, the e-cigarettes are widely used and gradually replace tobacco cigarettes.

Existing electronic cigarettes comprise a vaporizer and a battery stick. The electronic cigarette vaporizer, which is usually arranged with a vaporizer device comprising a vaporizing base, a vaporizing chamber, a vaporizing tube, etc., has complex structure and complicated manufacturing process. Due to structure and manufacturing technical reasons, poor sealing is a common problem. For example, when the connection between the vaporizing base and the liquid storage chamber has poor sealing, the e-cigarette liquid may leak into the vaporizing chamber and un-vaporized liquid may be fed to the user during using, thereby resulting in bad user experience.

SUMMARY

Technical Problem

An object of the disclosure is to provide an electronic cigarette vaporizer which not only has simple structure and manufacturing process, but also can avoid liquid leakage during using.

Technical Solutions

The disclosure provides technical solutions as follows. The electronic cigarette vaporizer comprises a housing and a bottom cap, and comprises a vaporizing base, a vaporizing unit and a vaporizing cover part which are arranged within the housing. The upper end of the housing is closed and is provided in a center with a mouthpiece hole. An inner conical tube extending downward is arranged at the mouthpiece hole. The bottom end of the housing is an open end, and the bottom cap is engaged with the open end. The bottom cap is provided in the center with a first air intake through-hole. The vaporizing base is arranged on the bottom cap. The vaporizing base is provided in a center with a rectangular groove, and a second air intake through-hole is formed at a center of the bottom portion of the rectangular groove. The vaporizing unit comprises a liquid guiding strip and a heating coil wound around a middle portion of the liquid guiding strip. The liquid guiding strip is transversely arranged above the rectangular groove. The lower portion of the vaporizing cover part is engaged with the top of the vaporizing base. The lower portion of the vaporizing cover part is arranged with a rectangle tube joint and the rectangle tube joint is fitted into the rectangular groove. The rectangle tube joint is formed with a cavity. The cavity and the rectangular groove of the vaporizing base constitute a vaporizing chamber. The upper portion of the vaporizing cover part is provided with a conical tube with an inner diameter increasing downwardly. The tube hole of the conical tube is in communication with the cavity of the rectangle tube joint. The upper end of the conical tube is sleeved within the inner conical tube. The mouthpiece hole is in communication with the vaporizing chamber by the conical tube. The bottom cap, the vaporizing base and the vaporizing cover part which are connected define an outer surface. A chamber is formed between the outer surface and the inner surface of the housing, and the chamber serves as a liquid storage chamber for storing cigarette liquid. Two ends of the liquid guiding strip extend into the liquid storage chamber so as to absorb cigarette liquid.

Preferably, the vaporizing base may comprise a baseplate. A surrounding wall extending upward may be formed at a peripheral edge of the baseplate. The outer wall of the surrounding wall can be engaged with the inner wall of the open end of the housing. A square loop shaped protruding part extending upward is arranged in the middle portion of the baseplate. The rectangular groove is arranged in a center of the square loop shaped protruding part. A symmetrical elongated transverse groove, which extends transversely and downward, is formed at left and right side wall portions of the square loop shaped protruding part. Two ends of the liquid guiding strip are mounted at the bottoms of the transverse grooves. The outer surfaces of the front and back side wall portions of the square loop shaped protruding part lie flush with the outer surface of the surrounding wall. The rectangle tube joint is arranged at left and right sides with protrusions extending downward and engaged with the transverse grooves. A cover wall is located outward of the protrusions. The cover wall tightly abuts against the outer wall of the left and right side wall portions of the square loop shaped protruding part. The vaporizing cover part defines notches at its front and back sides, and the notches are complemented with the front and back sides wall portions of the square loop shaped protruding part. The lower portion of the vaporizing cover part is formed at two sides with a vertical wall, and the vertical wall can be engaged with the inner wall of the surrounding wall.

Preferably, the outer wall of the left and right wall portions of the square loop shaped protruding part defines downward-extending longitudinal grooves respectively on two sides of the transverse grooves. Inward of the cover wall, supports are provided, and the supports are engaged with the longitudinal grooves.

Preferably, the surrounding wall and outer walls of the front and back side wall portions of the square loop shaped protruding part are arranged with sealing ridges extending transversely.

Preferably, the bottoms of the transverse grooves are formed as downwardly concaved hemispheres. The bottoms of the transverse grooves extend outward to form extending portions. The bottoms of the protrusions are formed as upwardly concaved hemispheres. The downwardly concaved hemispheres and the upwardly concaved hemispheres exactly define liquid guiding strip through holes for accommodating the liquid guiding strip. The cover wall is provided at two ends of the liquid guiding strip with cover wall holes, through which the liquid guiding strip can pass.

Preferably, the upper ends of the front and back side wall portions of the square loop shaped protruding part are downwardly arced, and the lower portion of the vaporizing cover part which is connected with the upper ends of the front and back side wall portions of the square loop shaped protruding part is corresponding arced, such that they can be tightly engaged.

Preferably, front and back wall portions of the rectangle tube joint are respectively arranged with a supporting piece protruding downward. The supporting piece is inserted in the rectangular groove and tightly abuts against the front and back inner walls of the rectangular groove. Preferably, the bottom of the vaporizing base defines a liquid filling through-hole which is in communication with the liquid storage chamber. The bottom cap is arranged with a plug extending upward to seal the liquid filling through-hole.

Preferably, an upper segment of the conical tube has a reduced diameter to form a diameter decreasing portion. The outer wall of the diameter decreasing portion is engaged with a tube shaped sealing sleeve.

Preferably, inside the vaporizing cover part, an annular groove extending upward is provided outside the bottom of the inner wall of the conical tube.

Advantages

In the electronic cigarette vaporizer which comprises the vaporizing base and the vaporizing cover part, the space inside the housing is divided into the liquid storage chamber and the vaporizing chamber. The device is simple in structure, small in size, easy to manufacture, and has high production efficiency. The vaporizing base and the vaporizing cover part which are respectively made of soft and hard materials have good fitting. In addition, the vaporizing base is arranged with longitudinal grooves and the rectangular groove, and the vaporizing cover part is arranged with supports and supporting piece. In the case that the longitudinal grooves and the supports are engaged with each other, and the rectangular groove and the supporting piece are tightly abut against each other, the vaporizing base which is made of soft material can be supported and fixed by the supports and the supporting piece which are made of hard materials. In this way, a reliable sealing connection can be achieved between the vaporizing base and the vaporizing cover part, and the detachment can be avoided to prevent leakage.

Figure 1:
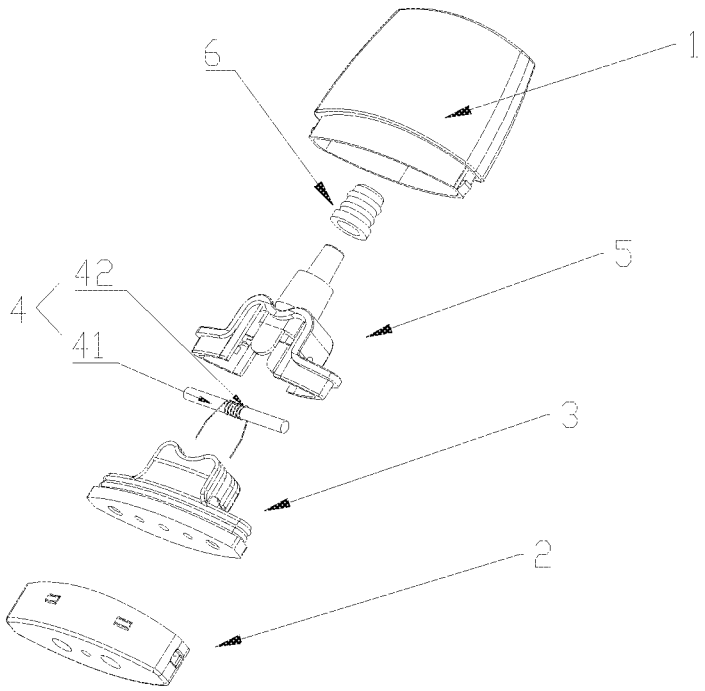
FIG. 1 is an exploded view according to an embodiment of the disclosure.

Herein, reference numerals of main components are as follows.

1. housing; 10. mouthpiece hole; 11. inner conical tube; 2. bottom cap; 20. first air intake through-hole; 21. electrodes; 22. plug; 23. snap-in hole; 3. vaporizing base; 30. baseplate; 31. surrounding wall; 311. sealing ridges; 32. square loop shaped protruding part; 321. rectangular groove; 322. transverse grooves; 323. longitudinal grooves; 324. extending portion; 33. second air intake through-hole; 34. liquid filling through-hole; 35. electrode holes; 4. vaporizing unit; 41. liquid guiding strip; 42. heating coil; 5. vaporizing cover part; 51. conical tube; 511. diameter decreasing portion; 512. annular groove; 52. rectangle tube joint; 521. supporting piece; 53. protrusions; 54. cover wall; 541. cover wall holes; 55. supports; 56. vertical wall; 57. notches; 6. sealing sleeve; 7. liquid storage chamber; 8. vaporizing chamber.

DETAILED DESCRIPTION OF ILLUSTRATED EMBODIMENTS

In order to make purposes, technical solutions and advantages of the disclosure clearer, the disclosure will be further explained in detail with reference to figures and embodiments described hereinafter.

Figure 2:
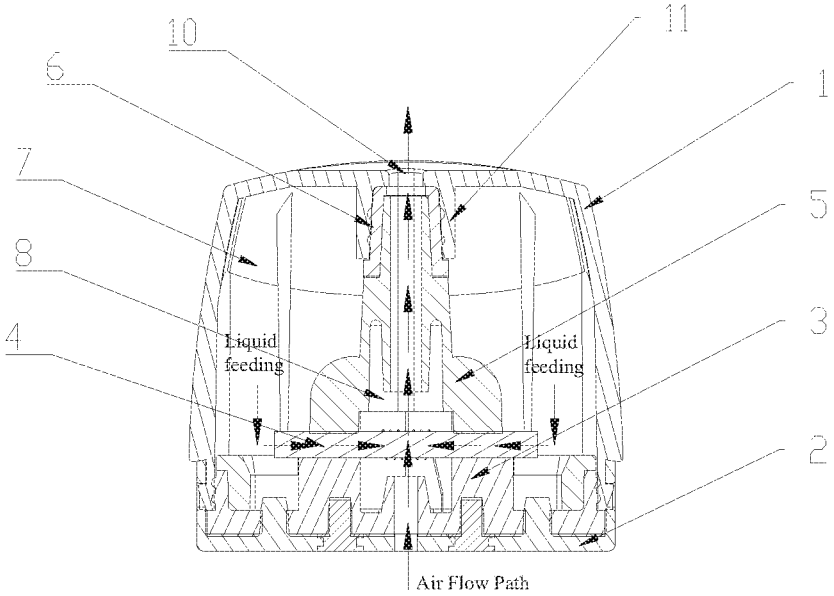
FIG. 2 is a cross-sectional view according to an embodiment of the disclosure.

For convenience of description, the electronic cigarette vaporizer of the disclosure is illustrated when the electronic cigarette vaporizer is vertically arranged, with the end where the mouthpiece hole 10 is formed being located in the upper position, as shown in FIG. 2. The terms, such as "upper", "lower", "upper portion", "lower portion", "upper end", "lower end", "upper surface" and "lower surface", as used in the disclosure, refer to position and orientation relationships when the electronic cigarette vaporizer is vertically arranged, with the mouthpiece end being located in the upper position.

Embodiments

Figure 3:
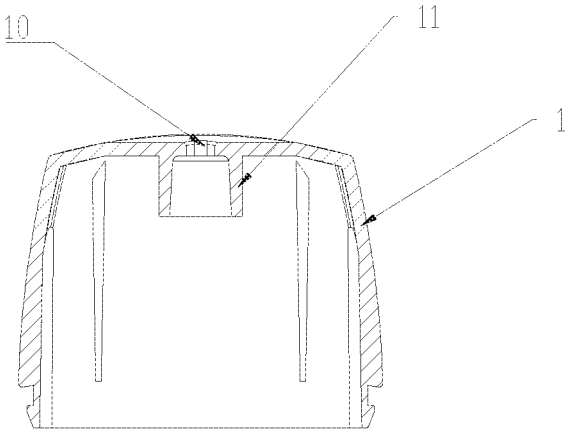
FIG. 3 is a cross-sectional view illustrating a housing according to an embodiment of the disclosure.

Referring to FIGS. 1, 2, and 3, the electronic cigarette vaporizer of the disclosure comprises a housing 1 and a bottom cap 2, and comprises a vaporizing base 3, a vaporizing unit 4 and a vaporizing cover part 5 which are arranged within the housing 1. The upper end of the housing 1 is closed and is provided in the center with a mouthpiece hole 10. Inside the housing 1, an inner conical tube 11 extending downward is arranged at the mouthpiece hole 10. The inner wall of the inner conical tube 11 is cone shaped, with the inner diameter gradually increasing downwardly. The bottom end of the housing 1 is an open end, and the bottom cap 2 is engaged with the open end. The bottom cap 2 is provided in the center with a first air intake through-hole. The vaporizing base 3 is arranged on the bottom cap 2. The vaporizing base 3 is provided in the center with a rectangular groove 321, and a second air intake through-hole is formed at the center of the bottom portion of the rectangular groove 321. The vaporizing unit 4 comprises a liquid guiding strip 41 and a heating coil 42 wound around a middle portion of the liquid guiding strip 41. The liquid guiding strip 41 is arranged above the rectangular groove 321 of the vaporizing base 3 and is suspended. The lower portion of the vaporizing cover part 5 is arranged with a rectangle tube joint 52 which can be fitted into the rectangular groove 321. The rectangle tube joint 52 is formed with a cavity. In the case that the vaporizing cover part 5 is engaged with the top of the vaporizing base 3, the cavity formed in the rectangle tube joint 52 and the rectangular groove 321 of the vaporizing base 3 constitute a vaporizing chamber 8. The upper portion of the vaporizing cover part 5 is provided with a conical tube 51 with the inner diameter increasing downwardly. The tube hole of the conical tube 51 is in communication with the cavity of the rectangle tube joint 52. The upper end of the conical tube 51 is sleeved within the inner conical tube 11.The mouthpiece hole 10 is in communication with the vaporizing chamber 8 by a conical tube 51. When the bottom cap 2, the vaporizing base 3 and the vaporizing cover part 5 are connected, a chamber is formed between their outer surfaces and the inner surface of the housing 1. The chamber serves as a liquid storage chamber 7 for storing cigarette liquid. Two ends of the liquid guiding strip 4 extend into the liquid storage chamber 7 so as to absorb cigarette liquid. Due to the structure that rectangle tube joint 52 and the rectangular groove 321 are engaged, the sealed vaporizing chamber 8 can be easily formed, and a tight connection between the vaporizing base 3 and the vaporizing cover part 5 can be achieved to avoid liquid leakage.

Referring to FIG. 2, during using, outside air enters through the first air intake through-hole 20, flows through the second air intake through-hole 33, and flows into the vaporizing chamber 8, as indicated by arrows. The cigarette liquid is fed from the liquid storage chamber 7 through the liquid guiding strip 41 to the heating coil 42, and then is heated and vaporized. The vaporized vapor flows from the vaporizing chamber 8 through the tube hole of the conical tube 51, flows through the mouthpiece hole 10 and then may enter user's mouth.

Figure 9:
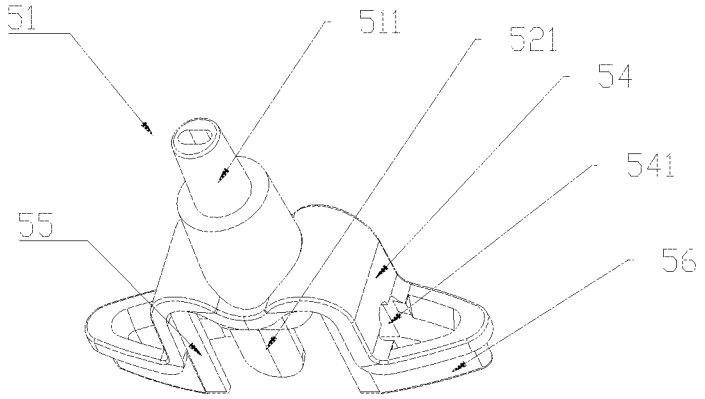
FIG. 9 is a first perspective view illustrating a vaporizing cover part according to an embodiment of the disclosure.
Figure 10:
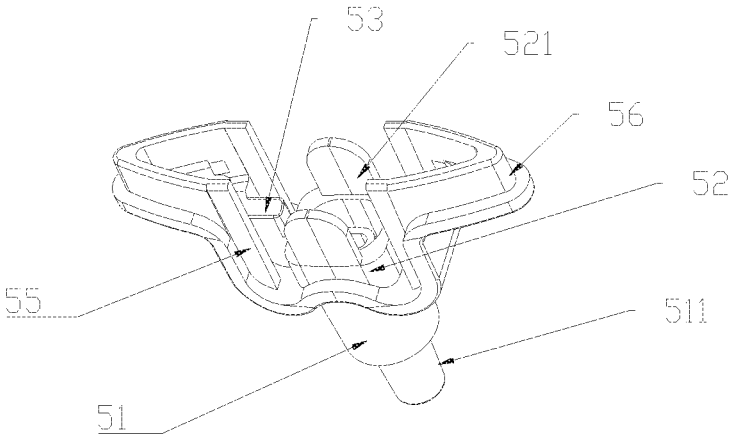
FIG. 10 is a second perspective view illustrating a vaporizing cover part according to an embodiment of the disclosure.
Figure 11:
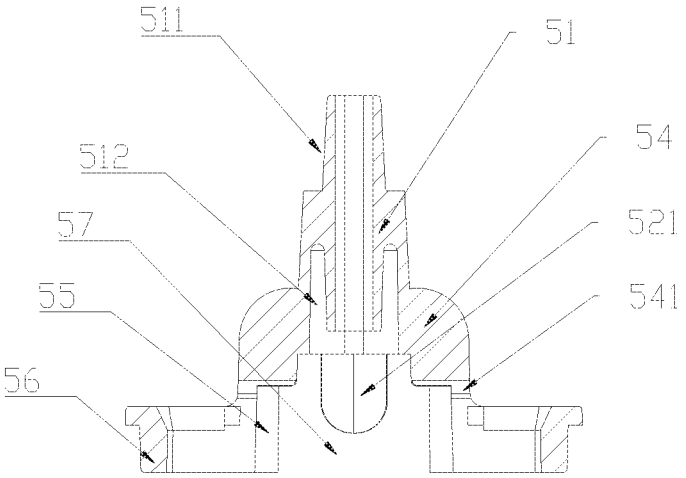
FIG. 11 is a cross-sectional view illustrating a vaporizing cover part according to an embodiment of the disclosure.
Figure 12:
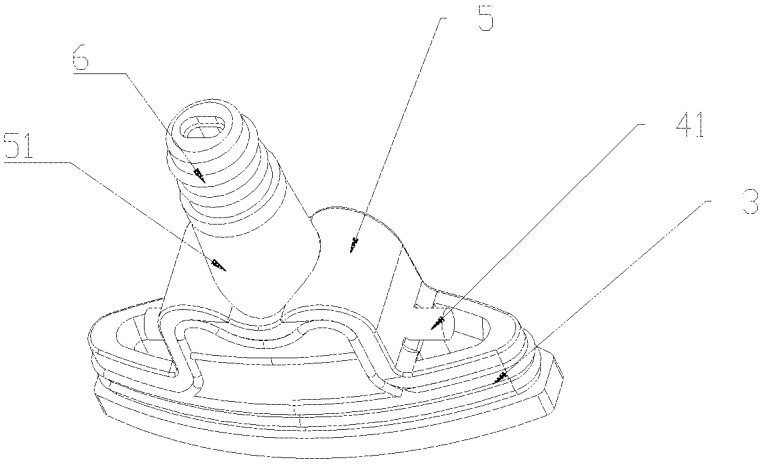
FIG. 12 is a perspective view according to an embodiment of the disclosure, in which a vaporizing base, a vaporizing cover part and a sealing sleeve are assembled.
Figure 13:
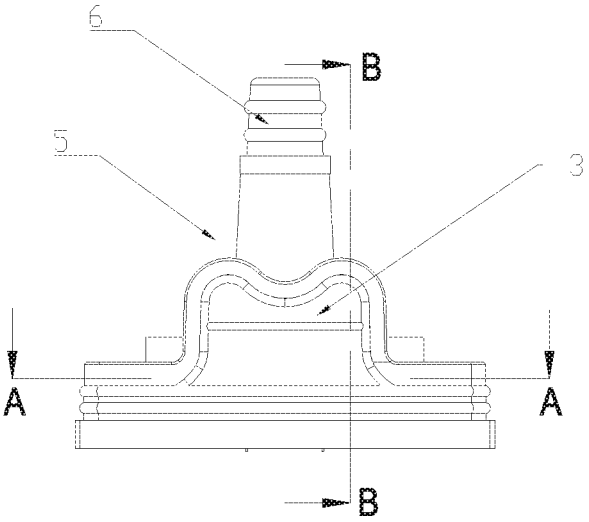
FIG. 13 is a front view according to an embodiment of the disclosure, in which a vaporizing base, a vaporizing cover part and a sealing sleeve are assembled.
Figure 14:
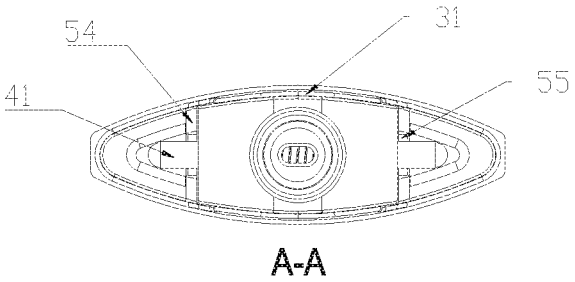
FIG. 14 is a cross-sectional view taken along line A-A of FIG. 13.
Figure 15:
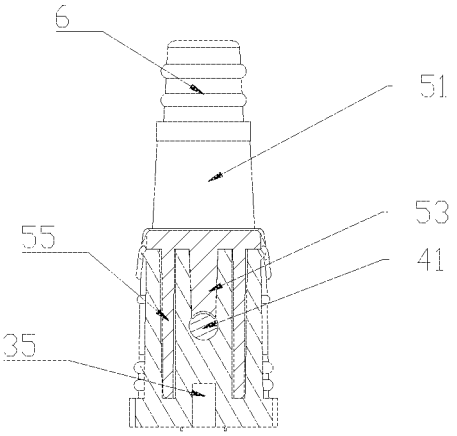
FIG. 15 is a cross-sectional view taken along line B-B of FIG. 13.

Referring to FIGS. 9-11, inside the vaporizing cover part 5, an annular groove 512 extending upward is provided outside the bottom of the inner wall of the conical tube 51. During using, un-vaporized small droplets mixed in the vapor can be condensed on inner wall of the annular groove 512. In this way, bad user experience caused by un-vaporized liquid directly fed to the user's mouth can be avoided.

Referring to FIGS. 4-15, the vaporizing base 3 comprises a baseplate 30. A surrounding wall 31 extending upward is formed at the peripheral edge of the baseplate 30. The outer wall of the surrounding wall 31 is engaged with the inner wall of the open end of the housing 1 in such a manner that the vaporizing base 3 is fixed on the housing 1. A square loop shaped protruding part 32 extending upward is arranged in the middle portion of the baseplate 30. The square loop shaped protruding part 32 is provided in the center with a rectangular groove 321. The symmetrical elongated transverse grooves 322, which extend transversely and downward, are formed at left and right side wall portions of the square loop shaped protruding part 32. Two ends of the liquid guiding strip 41 are mounted at the bottoms of the transverse grooves 322. A second air intake through-hole 33 is formed at a center of a bottom portion of the rectangular groove 321. The outer surfaces of the front and back side wall portions of the square loop shaped protruding part 32 lie flush with the outer surface of the surrounding wall 31. The rectangle tube joint 52 arranged at the lower portion of the vaporizing cover part 5 is inserted in the rectangular groove 321 to achieve engagement with the square loop shaped protruding part 32. The rectangle tube joint 52 is arranged at left and right sides with protrusions 53 extending downward and engaged with the transverse grooves 322. The protrusions 53 are complemented with the transverse grooves 322. The vaporizing cover part 5 is provided with a cover wall 54 located outward of the protrusions 53. The cover wall 54 tightly abuts against the outer wall of the left and right side wall portions of the square loop shaped protruding part 32. The vaporizing cover part 5 defines notches 57 at its front and back sides, and the notches 57 are complemented with the front and back sides wall portions of the square loop shaped protruding part 32. The lower portion of the vaporizing cover part 5 is formed at two sides with a vertical wall 56, and the vertical wall 56 can be engaged with the inner wall of the surrounding wall 31, to facilitate fixation of the vaporizing cover part 5 on the vaporizing base 3 and achieve reliable connection.

Referring to FIGS. 4, 5, 9, 10, 14, and 15, the outer wall of the left and right wall portions of the square loop shaped protruding part 32 defines downward-extending longitudinal grooves 323 respectively on two sides of the transverse grooves 322. The vaporizing cover part 5 is arranged with supports 55 located inward of the cover wall 54, and the supports 55 can be engaged with the longitudinal grooves 323. In the embodiment, the vaporizing base 3 is made of a soft silicone material which is resistant to high temperature, while the vaporizing cover part 5 is made of a hard material such as plastic material. During assembling and using, the connection between the vaporizing base 3 and the vaporizing cover part 5 may be released due to the difference between soft and hard materials. When they are released, the cigarette liquid in liquid storage chamber 7 may leak into the vaporizing chamber 8. In such case, un-vaporized liquid may be fed to the user and the device may not work properly. In the embodiment of the disclosure, due to the longitudinal grooves 323 and the supports 55 engaged with each other, the vaporizing base 3 which is soft can be supported and fixed by the four supports 55. In this way, a reliable connection there-between can be provided, the detachment can be avoided to prevent leakage.

Referring to FIGS. 9-11, front and back wall portions of the rectangle tube joint 52 are respectively arranged with a supporting piece 521 protruding downward. The supporting piece 521 is inserted in the rectangular groove 321 and tightly abuts against the front and back inner walls of the rectangular groove 321. Due to the supporting piece 521 tightly abutting against the inner walls of the rectangular groove 321, the vaporizing base 3 can be further supported and fixed. In this way, a reliable connection can be achieved between the vaporizing cover part 5 and the vaporizing base 3, and the detachment can be avoided to prevent leakage.

Figure 4:
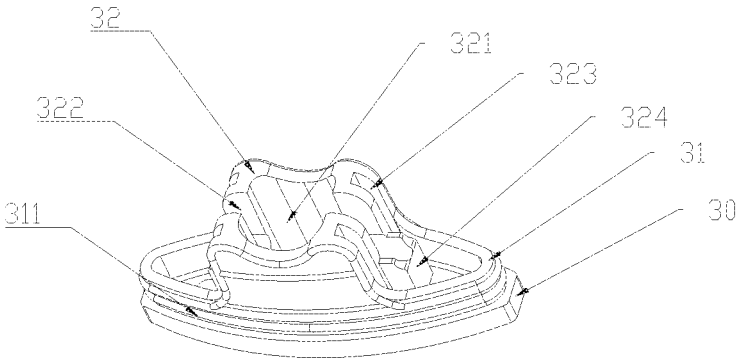
FIG. 4 is a first perspective view illustrating a vaporizing base according to an embodiment of the disclosure.
Figure 7:
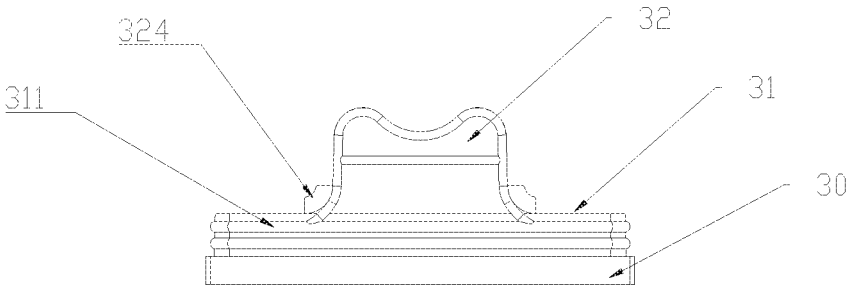
FIG. 7 is a front view illustrating a vaporizing base according to an embodiment of the disclosure.
Figure 8:
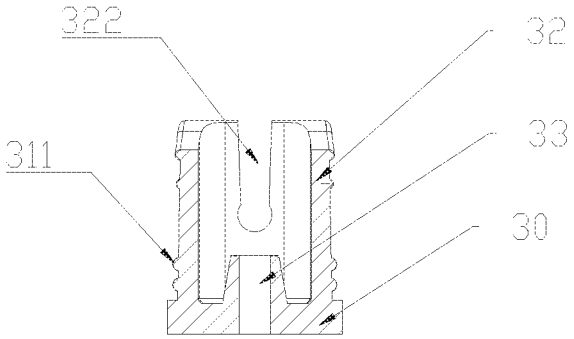
FIG. 8 is a side cross-sectional view illustrating a vaporizing base according to an embodiment of the disclosure.

Referring to FIGS. 4, 7, and 8, the surrounding wall 31 and outer walls of the front and back side wall portions of the square loop shaped protruding part 32 are arranged with sealing ridges 311 extending transversely. The sealing ridge 311 has a sealing effect to avoid leakage of the cigarette liquid stored in the liquid storage chamber 7.

Figure 5:
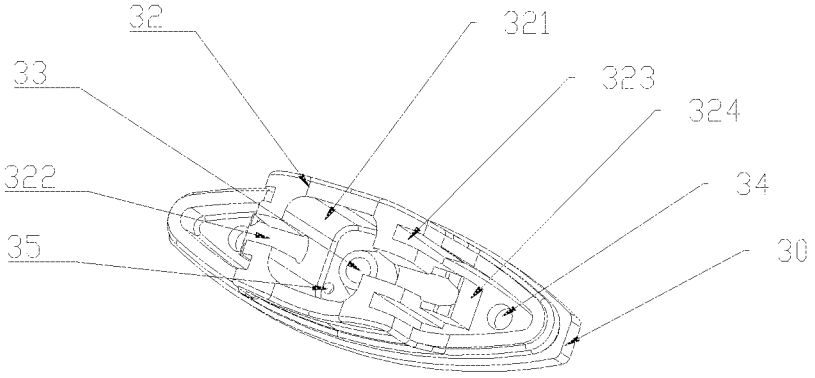
FIG. 5 is a second perspective view illustrating a vaporizing base according to an embodiment of the disclosure.

Referring to FIGS. 4, 5, and 7, the bottoms of the transverse grooves 322 are formed as downwardly concaved hemispheres, and the bottoms of the protrusions 53 are formed as upwardly concaved hemispheres. The downwardly concaved hemispheres and the upwardly concaved hemispheres exactly define a liquid guiding strip through hole for accommodating the liquid guiding strip. In this way, the liquid guiding strip 41 tightly abut against the transverse grooves 322 and the protrusions 53, and the liquid leakage caused by large gap can be avoided. The bottoms of the transverse grooves 322 extend outward to form extending portions 324. The upper portions of the extending portions 324 are arranged with semicircles downwardly concaved as the bottoms of the transverse grooves. In this way, the contact areas of the liquid guiding strip 41 and the transverse grooves 322 are increased, thereby improving sealing effect and further avoiding liquid leakage. The cover wall 54 is provided at two ends of the liquid guiding strip 41 with semicircular cover wall holes 541 through which the liquid guiding strip 41 can pass.

Referring to FIGS. 4-11, the upper ends of the front and back side wall portions of the square loop shaped protruding part 32 are downwardly arced, and the lower portion of the vaporizing cover part 5 which is connected with the upper ends of the front and back side wall portions of the square loop shaped protruding part 32 is corresponding arced, such that they can be tightly engaged. Since the upper ends of the front and back side wall portions of the square loop shaped protruding part 32 are downwardly arced, the height and area of the thinner area of the wall portions of the square loop shaped protruding part 32 can be reduced. In this way, vaporizing base 3 which is heated during using can be prevented from deforming, and a detachment of the connection with the vaporizing cover part 5 can be avoided to prevent leakage.

Figure 6:
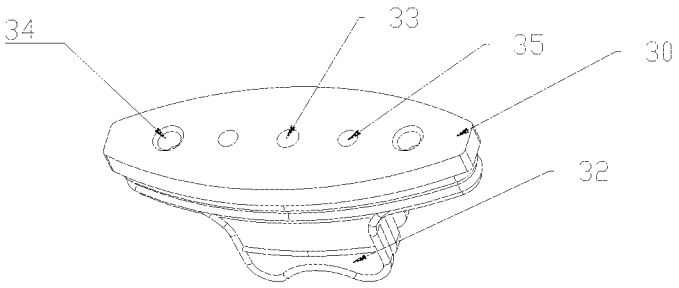
FIG. 6 is a third perspective view illustrating a vaporizing base according to an embodiment of the disclosure.

Referring to FIG. 6, the bottom of the vaporizing base 3 defines electrode holes 35 to communicate with rectangular groove 321, through which two ends of the leads of the heating coil can pass and in which the electrodes 21 can be accommodated.

Referring to FIGS. 5, 6, 16, and 17, the bottom of the vaporizing base 3 defines a liquid filling through-hole 34 which is in communication with the liquid storage chamber 7. The bottom cap 2 is arranged with a plug 22 extending upward to seal the liquid filling through-hole 34. In this way, it is convenient to add cigarette liquid during manufacturing or seal the liquid filling through-hole 34 by plug 22 to avoid leakage after the filling of cigarette liquid.

Referring to FIGS. 1, 2, and 9-13, an upper segment of the conical tube 51 has a reduced diameter to form a diameter decreasing portion 511. The diameter decreasing portion 511 is sleeved with a tube shaped sealing sleeve 6. The sealing sleeve 6, which is arranged between the diameter decreasing portion 511 and the inner conical tube 11, has a sealing effect to avoid leakage of the cigarette liquid stored in the liquid storage chamber 7.

Referring to FIGS. 1 and 4, the vaporizing base 3 is made of silicone material which is resistant to high temperature.

Figure 16:
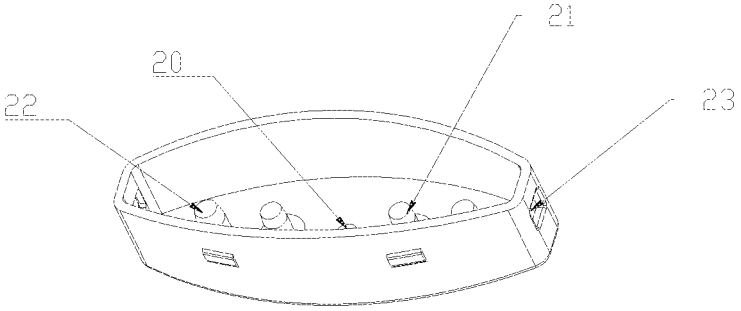
FIG. 16 is a perspective view illustrating a bottom cap according to an embodiment of the disclosure.
Figure 17:
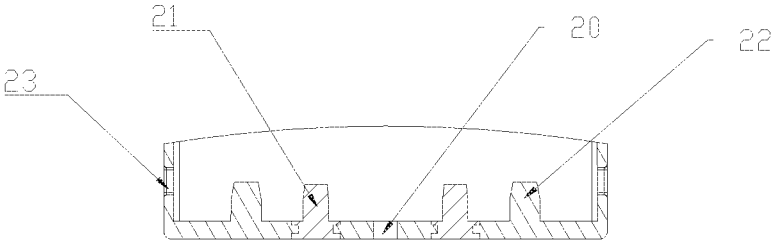
FIG. 17 is a cross-sectional view illustrating a bottom cap according to an embodiment of the disclosure.

Referring to FIGS. 16 and 17, the bottom of the bottom cap 2 is provided in the center with a first air intake through-hole 20, electrodes 21, a plug 22, and a snap-in hole 23. The electrodes 21 are connected with two ends of the leads of the heating coil 42, and can be connected with positive and negative electrodes of the battery stick to supply power for the heating coil 42. The male snap (not shown in the figures) of the housing 1 may be snap fitted in the snap-in hole 23 so as to fix the bottom cap 2 on the housing 1. The bottom cap 2 is arranged at its front and back sides with a male snap (not shown in the figures), so that it can be connected with the battery stick (not shown in the figures) to form a complete electronic cigarette.

INDUSTRIAL APPLICABILITY

All the above are merely preferred embodiments of the disclosure, which are not intended to limit the present invention in any form. The present invention is intended to cover all changes, various modifications and equivalent arrangements those skilled in the art can make according to the technical essence of the present invention.

The invention claimed is:

1. An electronic cigarette vaporizer, wherein the electronic cigarette vaporizer comprises a housing and a bottom cap, and comprises a vaporizing base, a vaporizing unit and a vaporizing cover part which are arranged within the housing, an upper end of the housing is closed and is provided in a center with a mouthpiece hole, an inner conical tube extending downward is arranged at the mouthpiece hole, a bottom end of the housing is an open end with which the bottom cap is engaged, the bottom cap is provided in a center with a first air intake through-hole, the vaporizing base is arranged on the bottom cap, the vaporizing base is provided in a center with a rectangular groove, and a second air intake through-hole is formed at a center of a bottom portion of the rectangular groove, the vaporizing unit comprises a liquid guiding strip and a heating coil wound around a middle portion of the liquid guiding strip, the liquid guiding strip is transversely arranged above the rectangular groove, a lower portion of the vaporizing cover part is engaged with a top portion of the vaporizing base, the lower portion of the vaporizing cover part is arranged with a rectangle tube joint and the rectangle tube joint is fitted into the rectangular groove, the rectangle tube joint is formed with a cavity, a vaporizing chamber is defined by the cavity and the rectangular groove of the vaporizing base, an upper portion of the vaporizing cover part is provided with a conical tube with an inner diameter increasing downwardly, a tube hole of the conical tube is in communication with the cavity of the rectangle tube joint, an upper end of the conical tube is sleeved within the inner conical tube, the mouthpiece hole is in communication with the vaporizing chamber by the conical tube, wherein the bottom cap, the vaporizing base and the vaporizing cover part which are connected define an outer surface, a chamber is formed between the outer surface and an inner surface of the housing, and the chamber serves as a liquid storage chamber for storing cigarette liquid, two ends of the liquid guiding strip extend into the liquid storage chamber to absorb cigarette liquid.

2. The electronic cigarette vaporizer according to claim 1, wherein the vaporizing base comprises a baseplate, a surrounding wall extending upward is formed at a peripheral edge of the baseplate, an outer wall of the surrounding wall is engaged with an inner wall of the open end of the housing, a square loop shaped protruding part extending upward is arranged in a middle portion of the baseplate, the rectangular groove is arranged in a center of the square loop shaped protruding part, symmetrical elongated transverse grooves which extend transversely and downward are formed at left and right side wall portions of the square loop shaped protruding part, two ends of the liquid guiding strip are mounted at bottoms of the transverse grooves, outer surfaces of front and back side wall portions of the square loop shaped protruding part lie flush with an outer surface of the surrounding wall, the rectangle tube joint is arranged at left and right sides with a protrusion extending downward and engaged with the transverse grooves, a cover wall is located outward of the protrusion and tightly abuts against outer walls of the left and right side wall portions of the square loop shaped protruding part, the vaporizing cover part defines notches at front and back sides, and the notches are complemented with front and back sides wall portions of the square loop shaped protruding part, a lower portion of the vaporizing cover part is formed at two sides with a vertical wall, and the vertical wall is engaged with an inner wall of the surrounding wall.

3. The electronic cigarette vaporizer according to claim 2, wherein an outer wall of left and right wall portions of the square loop shaped protruding part defines downward-extending longitudinal grooves respectively on two sides of the transverse groove, and, inward of the cover wall, supports are provided, and the supports are engaged with the longitudinal grooves.

4. The electronic cigarette vaporizer according to claim 2, wherein the surrounding wall and outer walls of front and back side wall portions of the square loop shaped protruding part are arranged with a sealing ridge extending transversely.

5. The electronic cigarette vaporizer according to claim 2, wherein a bottom of the transverse groove is formed as a downwardly concaved hemisphere, a bottom of the transverse groove extends outward to form an extending portion, a bottom of the protrusion is formed as an upwardly concaved hemisphere, the downwardly concaved hemisphere and the upwardly concaved hemisphere exactly define a liquid guiding strip through hole for accommodating the liquid guiding strip, and the cover wall is provided at two ends of the liquid guiding strip with cover wall holes, through which the liquid guiding strip can pass.

6. The electronic cigarette vaporizer according to claim 2, wherein upper ends of the front and back side wall portions of the square loop shaped protruding part are downwardly arced, and a lower portion of the vaporizing cover part which is connected with upper ends of the front and back side wall portions of the square loop shaped protruding part is corresponding arced, to allow a tight engagement therebetween.

7. The electronic cigarette vaporizer according to claim 1, wherein front and back wall portions of the rectangle tube joint are respectively arranged with a supporting piece protruding downward, and the supporting piece is inserted in the rectangular groove and tightly abuts against front and back inner walls of the rectangular groove.

8. The electronic cigarette vaporizer according to claim 1, wherein a bottom of the vaporizing base defines a liquid filling through-hole which is in communication with the liquid storage chamber, the bottom cap is arranged with a plug extending upward to seal the liquid filling through-hole.

9. The electronic cigarette vaporizer according to claim 1, wherein an upper segment of the conical tube having a reduced diameter forms a diameter decreasing portion, and an outer wall of the diameter decreasing portion is engaged with a tube shaped sealing sleeve.

10. The electronic cigarette vaporizer according to claim 1, wherein inside the vaporizing cover part, an annular groove extending upward is provided outside a bottom of an inner wall of the conical tube.

* * * * *